US008814077B2

(12) United States Patent
Kervinen et al.

(10) Patent No.: US 8,814,077 B2
(45) Date of Patent: Aug. 26, 2014

(54) SELF CENTERING CORE ADAPTER AND METHOD

(75) Inventors: Ismo Kervinen, Kotka (FI); Marko Ilomaki, Kotka (FI); Markku Ronnila, Kotka (FI)

(73) Assignee: Sonoco Development Inc., Hartsville, SC (US)

( * ) Notice: Subject to any disclaimer, the term of this patent is extended or adjusted under 35 U.S.C. 154(b) by 363 days.

(21) Appl. No.: 13/114,328

(22) Filed: May 24, 2011

(65) Prior Publication Data

US 2012/0111990 A1 May 10, 2012

Related U.S. Application Data

(60) Provisional application No. 61/410,512, filed on Nov. 5, 2010, provisional application No. 61/446,519, filed on Feb. 25, 2011.

(51) Int. Cl.
*B65H 75/18* (2006.01)

(52) U.S. Cl.
CPC ..... *B65H 75/185* (2013.01)
USPC ..... 242/609.1; 242/613.5

(58) Field of Classification Search
USPC ..... 242/160.4, 912, 609, 611.2, 596.7, 242/613.5, 609.1; 206/389
See application file for complete search history.

(56) References Cited

U.S. PATENT DOCUMENTS

| | | | | |
|---|---|---|---|---|
| 1,858,753 | A | 5/1932 | Taylor | |
| 5,469,619 | A | 11/1995 | Renck | |
| 7,536,763 | B2 * | 5/2009 | Offerhaus | 29/283 |
| 2001/0032904 | A1 | 10/2001 | Liu | |
| 2006/0169709 | A1 * | 8/2006 | Bailey et al. | 221/26 |
| 2011/0017861 | A1 * | 1/2011 | Nakanishi et al. | 242/533 |

FOREIGN PATENT DOCUMENTS

| | | | |
|---|---|---|---|
| GB | 952 433 | A | 3/1964 |
| JP | 2001031329 | A | 2/2001 |
| JP | 2003170989 | A | 6/2003 |
| JP | 2003212440 | A | 7/2003 |
| WO | WO 2005/040022 | A1 | 5/2005 |

OTHER PUBLICATIONS

International Preliminary Report on Patentability—PCT/US2011/037743, May 7, 2013, Sonoco Development Inc.
International Search Report and Written Opinion dated Sep. 15, 2011 for PCT/US2011/037743.

* cited by examiner

*Primary Examiner* — William A Rivera
*Assistant Examiner* — Angela Caligiuri
(74) *Attorney, Agent, or Firm* — Womble Carlyle Sandridge & Rice LLP

(57) ABSTRACT

A core adapter is provided for adapting a larger diameter core to be mounted on a winding machine designed for a smaller diameter core. The core adapter includes a cylindrical body having a wall, a central bore, an outer surface, and a discontinuity in the form of a slit extending axially along and completely through the wall. The core adapter can be inserted in an end of a core and progressively secured by expanding the body, facilitated by a widening of the slit, until the body wedges against the inside surface of the core. Adhesive can be applied to the adapter or the core or both to secure the core adapter in place. The body can be expanded with screws progressively threaded through the core and into the body of the core adapter, or vice versa. Alternatively, the body can be expanded by urging a wedge into the slit to widen the slit and consequently expand the body of the core adapter radially. Alternatively still, the body can be expanded with an expandable tool inserted through the central bore of the body and expanded against the wall of the central bore. A system including a core adapter and expansion tool and methods of expanding the core adapter are also disclosed.

25 Claims, 8 Drawing Sheets

| Position | | Maximum Testing Force | Axial Displacement at Maximum Force |
|---|---|---|---|
| 1st (Best) | 8 Screws + Glue | 46.5 KN | 1.44 mm |
| 2nd | 4 Screws + Glue | 30 KN | 1.42 mm |
| 3rd | 12 Screws | 39 KN | 3.03 mm |
| 4th | 8 Skew and 4 Straight Screws | 37.8 KN | 3.8 mm |
| 5th (Worst) | 8 Screws | 18.2 KN | 2.7 mm |

SELF CENTERING CORE ADAPTER AND METHOD

REFERENCE TO RELATED APPLICATION

Priority is hereby claimed to the filing date of U.S. provisional patent application No. 61/410,512 entitled Self Centering Core Adapter filed on Nov. 5, 2010 and to the filing date of U.S. provisional patent application No. 61/446,519 filed on Feb. 25, 2011.

TECHNICAL FIELD

This disclosure relates generally to cores upon which web material such as paper, film, and the like are wound, and more specifically to adapting larger diameter cores to be mounted on winding machines and other machines having smaller diameter spindles or chucks.

BACKGROUND

Long cylindrical cores made of plastic or spirally wound paperboard are commonly used to wind large quantities of web material such as, for example, paper or film into rolls for storage and transport. Some cores have inner diameters (ID) that are larger than those of other cores. For example, cores having IDs of 150 millimeter (mm) are common as are cores having 76 mm IDs. It is desirable to mount both large and small ID cores on winding machines such as double drum winders that have spindles or chucks configured to accept smaller ID cores only. In order to do this, core adapters may be installed in the ends of the larger ID cores and the adapters have central bores that can be mounted on the smaller ID spindles or core chucks of a winding or other machine. Traditional core adapters take many forms such as, for instance, leaf adapters with leafs that can expand to lock the adapter in the end of the core, rubber air or pneumatic adapters that are inserted in the core ends and inflated to lock them in place, and others. Core adapters made of wound paper in the form of one or multiple concentrically arranged components also are known. While somewhat successful, these traditional adapters can be expensive, do not always ensure a precisely centered smaller central opening, and can be unintentionally left off, which necessitates a time consuming rewinding of the web material. Traditional core adapters also may not ensure precise concentricity of the smaller opening of the adapter with the larger opening of the core. It is to a core adapter that addresses these and other shortcomings of traditional core adapters that the present invention is primarily directed.

SUMMARY

U.S. provisional patent application Nos. 61/410,512 and 61/446,519; to which priority is claimed above, are hereby incorporated by reference in their entireties.

Briefly described, a core adapter preferably is made of wound paper plies and includes a generally cylindrical or annular body having walls that surround a central bore sized to receive a spindle or chuck. The body has an outer diameter (OD) sized to fit into the end of a core having a larger ID and the central bore is sized to receive a spindle or chuck having a smaller ID. An axially extending discontinuity in the form of a slit is formed and extends completely along the length of the body and also extends completely through the wall of the body from the central bore to the outer surface of the body. In one embodiment, a series of attachment holes may be drilled either at an angle through the end of the adapter or through the walls of the core at its ends. Attachment holes also need not be drilled. To install the core adapter of this embodiment in a larger ID core, the adapter is slid into the ends of a core and attached with screws or other fasteners. In the embodiment with attachment holes drilled through the end of the adapter, screws may be inserted through the attachment holes and treaded into the core. In the embodiment with attachment holes formed in the core, screws may be inserted through the attachment holes and threaded into the body of the adapter. When no attachment holes are present, screws may simply be threaded through the core and into the adapter or vice versa. In either case, the screws preferably are installed in a predetermined sequence that causes the adapter to expand progressively outwardly facilitated by a widening of the axially extending slit in the adapter. When all the screws are installed, the adapter is lodged tightly in the end of the core, the slit is widened from its normal or rest width, and the central bore of the core adapter is precisely centered within the core.

In another embodiment, adhesive may be applied to the outer surface of the adapter or the inner surface of the core. The adapter may then slid into the end of a core and a specially configured wedge can be driven into the slit of the adapter in one of several possible ways. As the wedge advances into the slit, it forces the slit to widen, which, in turn, expands the adapter radially until it engages the inner surface of the core. After the adhesive cures, the wedge may be removed or left in place and the adapter is securely and adhesively fixed within the end of the core with its central bore centered and aligned coaxially within the core. As an alternative to spreading the slit with a wedge, an expandable tool such as a core chuck can be inserted through the central bore of the core adapter and expanded to force the adapter against the inner wall of the core until the adhesive sets, whereupon the tool can be removed. The core can then be mounted on winding and other machines with smaller chucks or spindles.

Thus, a core adapter is now provided that is inexpensive, simple and reliable in operation, consistently results in a precisely centered smaller central bore for mounting on a spindle, and can be installed easily and quickly without specialized equipment. Since the adapter is made, in a preferred embodiment, of densely wound paper plies, the core can support exceedingly heavy loads such as, for instance, over 500 kg up to about 5 metric tons. Surprisingly, it has been found that the slit extending completely through the wall of the core adapter has no detrimental effect on the adapter's ability to bear such high weights, even when the adapter is made of wound paper. This result is somewhat contrary to what a skilled artisan might believe since it might be assumed that the presence of the slit would degrade the structural integrity of the core adapter. Significantly, when the core adapter is inserted into the end of a core and expanded against the inner wall of the core, the central bore of the core adapter is very precisely centered and aligned axially with the axis of the core itself. This prevents uneven rotation of the core during winding or unwinding. These and other features, aspects, and advantages of the core adapter will become more apparent upon review of the detailed description set forth below taken in conjunction with the accompanying drawing figures, which are briefly described as follows.

DETAILED DESCRIPTION

Figure 1:
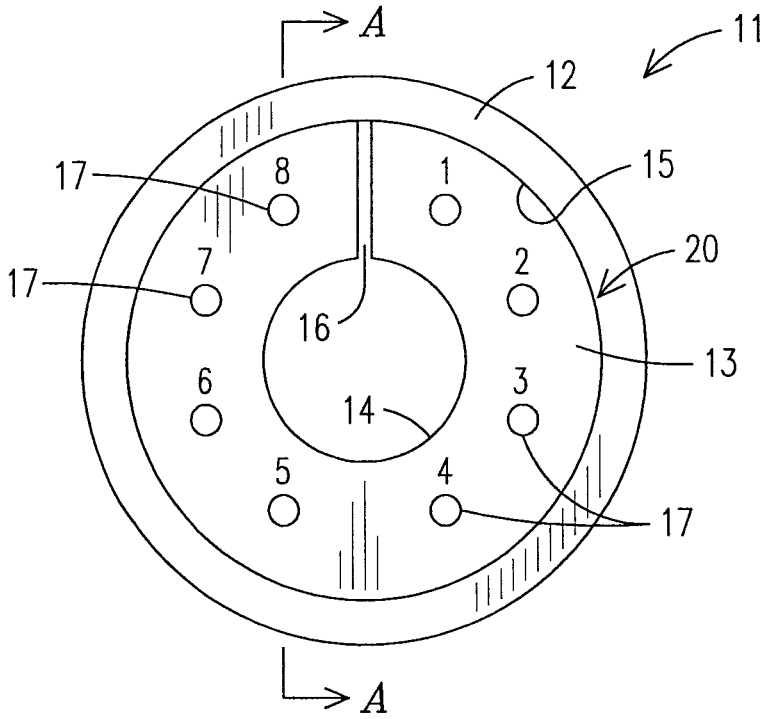
FIG. 1 is an end view of a core having a core adapter according to one embodiment of this disclosure installed therein.

Reference will now be made to the drawing figures, wherein like reference numerals identify like parts throughout related views of each embodiment. The core adapter will be described herein in terms of adapting a 150 mm ID core for mounting on a spindle configured for receiving 76 mm cores. It should be understood, however, that the invention is not so limited and applies to cores of any combination of larger and smaller ID. The description below is of preferred embodiments of the core adapter and methods of fixing it in the ends of a core. The embodiments are presented only as examples. Many variations are possible, and some are mentioned throughout the following description.

Figure 2:
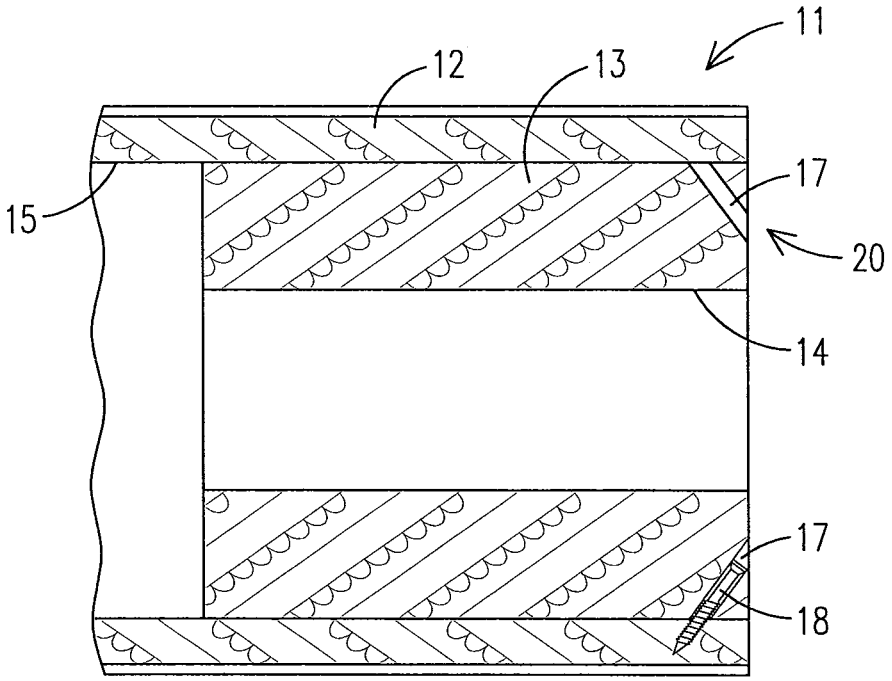
FIG. 2 is a cross-sectional view taken generally along A-A of FIG. 1 and illustrating one possible screw placement.

Referring to FIGS. 1 and 2, an adapter-core combination 11 includes a cylindrical core 12 having an interior surface 15 defining a 150 mm ID of the core. A generally cylindrical core adapter 20 according to one embodiment of the disclosure is installed in the ends of the core (only one end shown) to adapt the 150 mm ID core for mounting on the spindles or chucks of a winding machine made to accept cores with a smaller 76 mm ID. The core adapter 20 has an annular or cylindrical body 13 with a central bore 14, such that the body defines a relatively thick wall that surrounds the central bore. An axially extending discontinuity or slit 16 is formed in the wall of the body and extends completely along the length of the body. The slit also extends completely through the wall of the body from the central bore to the outer surface of the body. It will thus be seen that the slit 16 forms a complete and total discontinuity or separation in the wall of the adapter body. Thus, the core adapter may be expanded radially facilitated by a widening of the slit 16. A corresponding radial expansion of the diameter of the central bore of the adapter also is obtained.

A series of attachment holes 17 may be formed through the ends of the adapter body 13 and, as best illustrated in FIG. 2, may be angled toward the wall of the core 12. Any appropriate angles may be selected so long as the holes extend toward a core in which the adapter is mounted. The adapter 20 can be fixed within the end of the core with screws 18 (FIG. 2) that are inserted through the attachment holes 17 and treaded into the body of the core as shown. The screws may have a non-threaded upper shaft so that the body 13 of the adapter is drawn tightly against the interior surface 15 of the core when the screws are threaded through the adapter body and into the core. In this regard, it has been found that attachment holes need not be drilled and, in such cases, the screws can simply be threaded through the core into the adapter or vice versa.

The outer diameter of the core adapter when the adapter is at rest (i.e. unexpanded) may be slightly less than the ID of a core, or it may be the same or slightly greater. To install the core adapter, it is slid into the end of a 150 mm ID core to the position shown in FIGS. 1 and 2 (or to some other desired position). Easy sliding is facilitated by the slightly smaller OD of the adapter (or, alternatively, the adapter can flex to a smaller diameter as a result of narrowing of the axially extending slit 16). When the core adapter is in place, it may be secured with screws as described above. More specifically, the screws may be installed and tightened one-at-a-time and preferably in a predetermined sequence. In the illustrated embodiment, the sequence extends from one side of the slit 16 sequentially around the adapter to the other side of the slit 16. This sequence is indicated by the numbers next to the attachment holes in FIG. 1. The invention is not limited to this sequence, however, and other sequences (or no sequence at all in some cases) may be employed by skilled artisans such as, for instance, the sequence 4-3-2-1-5-6-7-8, with equivalent results. In any event, the sequence is predetermined such that the tightening of the screws progressively expands the adapter body 13 firmly against the interior surface of the core. As mentioned, this expansion is facilitated by a widening of the axially extending slit 16 as the screws are progressively tightened.

The adapter is configured such that when it is fully secured within and expanded against the inner surface of the core, its central bore 14 is precisely centered and aligned axially with the axis of the core. Further, the central bore of the installed expanded adapter is precisely sized to receive the 76 mm spindle or chuck of a winding machine. A second core adapter can be installed in the opposite end of the core in the same way. The 150 mm ID core can then be mounted on a winding machine such as a double drum winder designed to accept 76 mm ID cores. The complete discontinuity in the wall of the adapter formed by the axially extending slit 16 ensures that the expansion and fixing of the core adapter as described is reliable, complete, and repeatable.

Figure 3:
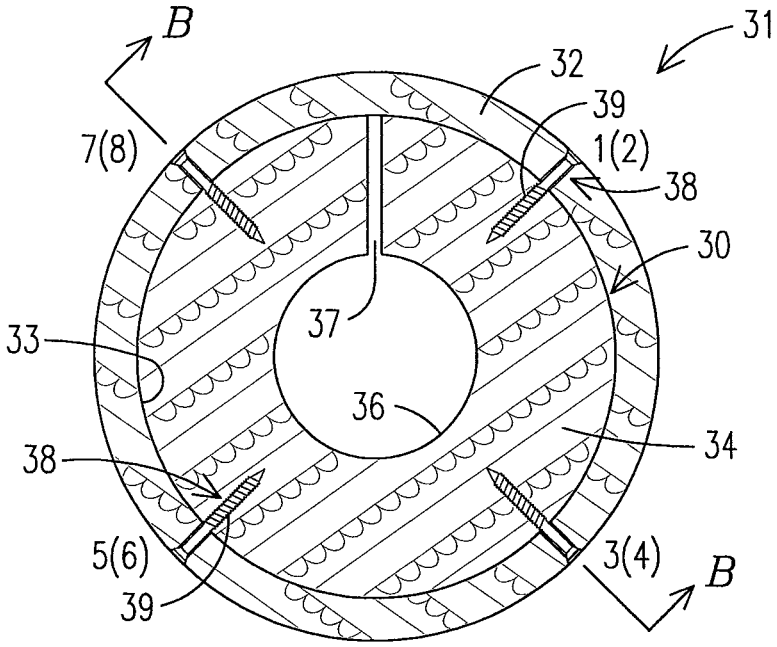
FIG. 3 is an end view of a core having a core adapter according to an alternate embodiment installed therein.
Figure 4:
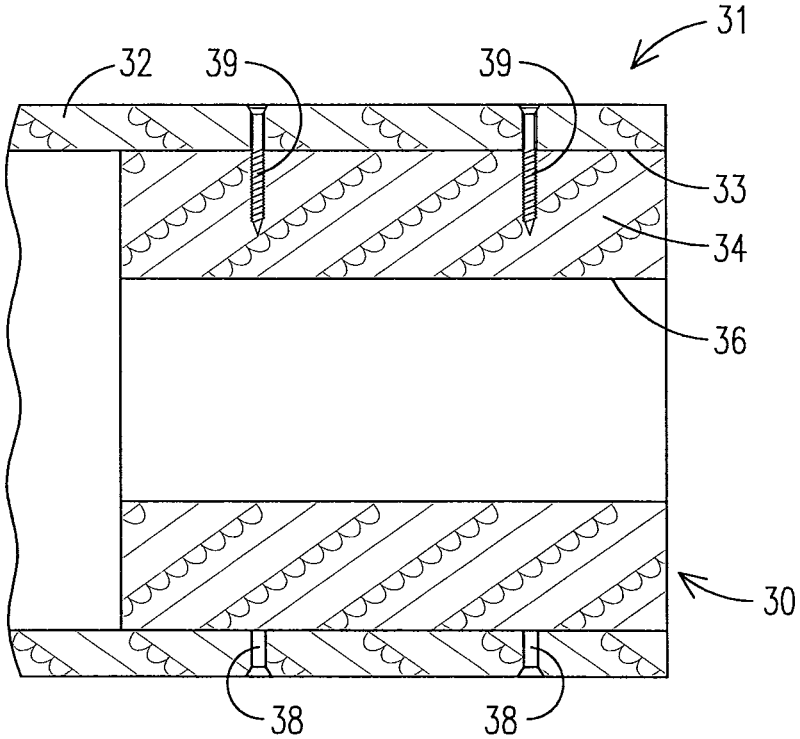
FIG. 4 is a cross-sectional view taken generally along B-B of FIG. 3 illustrating another possible screw placement.

FIGS. 3 and 4 illustrate an alternate embodiment and another example of a core adapter according to the invention that is secured in an alternate way with comparable results. The combination 31 in this embodiment comprises a core 32 having an inner wall 33 defining an ID of 150 mm and a core adapter 30 secured within the core 32 by screws 39. In this embodiment, attachment holes 38 may be formed through the core itself and screws 39 (or other fasteners) may be installed through the attachment holes 38 and driven into the body 34 of the core. Alternatively, the screws may be of the type having a non-threaded smaller upper shaft, or the adapter may be fastened with nails or staples, in which case no pre-drilled attachment holes or only a countersink or indicator at desired locations is needed in the core. In fact, the inventors have discovered that there is little benefit to pre-drilling attachment holes in the core and/or adapter when using screws. Accordingly, the use of pre-drilled holes, while an option, has been discovered not to represent the preferred technique when using screws to attach the core and core adapter together.

The embodiment of the core adapter shown in FIGS. 3 and 4 is installed by slipping the core adapter into an end of the core and expanding it by driving screws through the core and into the body 34 of the adapter. As with the embodiment of FIGS. 1 and 2, the screws preferably are installed in a predetermined sequence such that the adapter is progressively expanded as the screws are tightened to fit firmly against the inner wall 33 of the core. In the illustrated embodiment, the screws are tightened in pairs and in sequence from one side of the slit 37 of the adapter around to the other side of the slit 37 as indicated by the numbers next to the screws. This expands the adapter body progressively outwardly against the inner surface of the core, facilitated by the consequent widening of the slit 37, until the adapter is firmly secured in the end of the core and its central bore 36 is precisely sized, centered, and axially aligned with respect to the core. The preferred sequence of tightening is illustrated in FIG. 3 by the small numbers near the heads of the screws (the illustrated sequence is 1(2)-3(4)-5(6)-7(8)). However, this particular sequence is not a limitation of the invention and other sequences may be designated with comparable results. For example, the sequence 3(4)-1(2)-5(6)-7(8) may be predetermined as may other sequences that urge or draw the core adapter 30 tightly against the inner wall of the core in a progressive manner. In addition, no particular sequence at all may be used in some instances.

Figure 5:
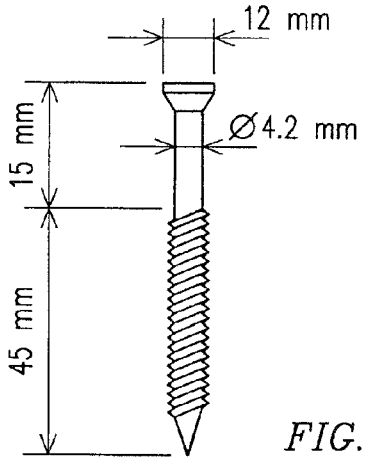
FIG. 5 is a side elevational view of a screw configuration optimized for use with the adapter of this disclosure.

FIGS. 5-9 illustrate the results of supplemental testing on core adapters fixed or secured in the ends of cores in a variety of ways in order to determine the optimum fixing configuration for the core adapters of this disclosure when using screws as discussed above. FIG. 5 illustrates a screw having a size and configuration that was determined to be quite optimal for fixing core adapters according to the forgoing embodiments discussed in this disclosure. The screw preferably has a torox or frustroconical base. As shown, the optimal length of the screw is about 45 millimeters (mm), although it can be a few mm shorter but preferably not much longer. Note also that the unthreaded shank of the screw between its head and its treads is about 15 mm long and the diameter of the shank is about 4.2 mm, which is less that the diameter of the threaded portion of the screw.

Figure 6:
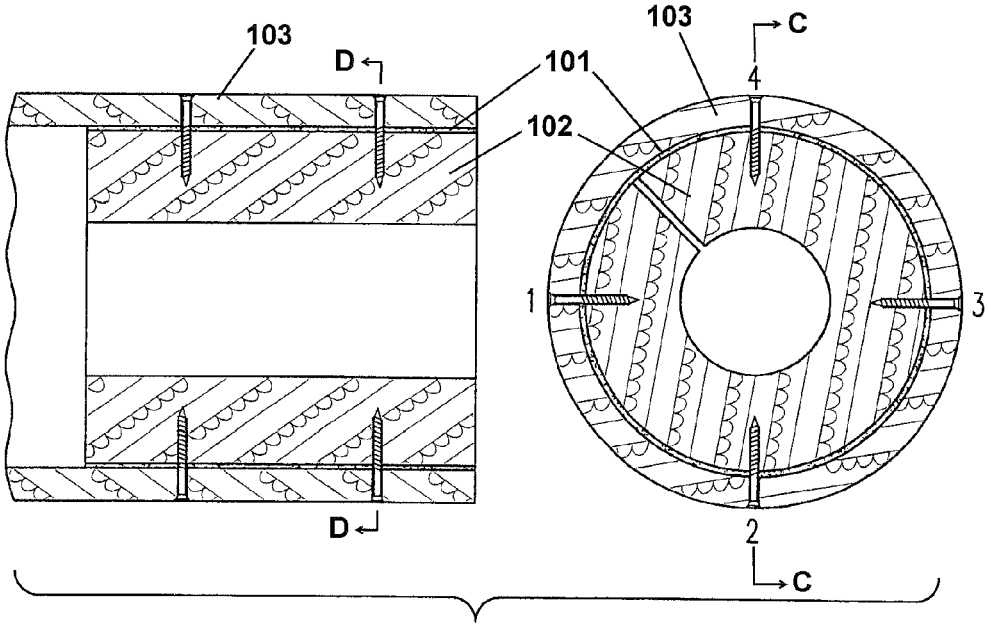
FIG. 6 includes a side cross-sectional view taken along axis C-C and an end cross sectional view taken along axis D-D of a core adapter according to this disclosure installed in an end of a core using the screws of FIG. 5.

FIG. 6, which includes two orthogonal cross sections, illustrates the optimum or preferred configuration and method of setting a core adapter 102 in the end of a core 103 using the screws of FIG. 5 according to the testing conducted by the inventors detailed below. More specifically, a coating 101 of appropriate adhesive such as white or yellow glue is applied to the outer surface of the adapter, to the inner surface of the core, or both. The core adapter 102 is then slid into the end of the core 103. Since, as discussed above, the initial diameter of the core adapter 102 may be less than its final expanded diameter, the fit while sliding the core adapter into the end of the core 103 is relatively loose. This prevents much of the glue from being scraped off of the adapter and/or the interior wall of the core as the core adaptor slides in. In the event that a particular core adapter should fit too tightly to slide in without scraping off the adhesive, then a new core adapter should be selected. With the core adapter 102 in place, the screws are threaded in and tightened in the order shown on the right in FIG. 6, i.e. from one side of the slit in the core adapter sequentially around to the other side of the slit (1, 2, 3, 4). This sequence also may be reversed and progress in the opposite direction (4, 3, 2, 1) if desired or another sequence may be applied.

As discussed above, the sequenced tightening of the screws causes the core adapter to expand progressively and uniformly and also centers the central bore of the adapter within the core. Significantly, because of the smaller shanks of the screws as shown in FIG. 5, no pilot holes need be drilled through the wall of the core prior to installing the screws. As the screws are tightened, their heads are countersunk to be flush with or just below the surface of the core so that the screw heads will not contact with a winding drum in use. Further, the length of the screws as shown in FIG. 5 insures that, when the heads are properly countersunk, the tips of the screws do not protrude into the central opening of the core adapter, which could interfere with the mounting of the core. When the screws are installed and tightened, the outer surface of the adapter should be pulled tightly against the inner surface of the core and its central opening should be precisely centered with respect to the axis of the core. When the adhesive sets, the adapter is permanently and securely fixed within its core.

Test Results

Figures 7, 8:
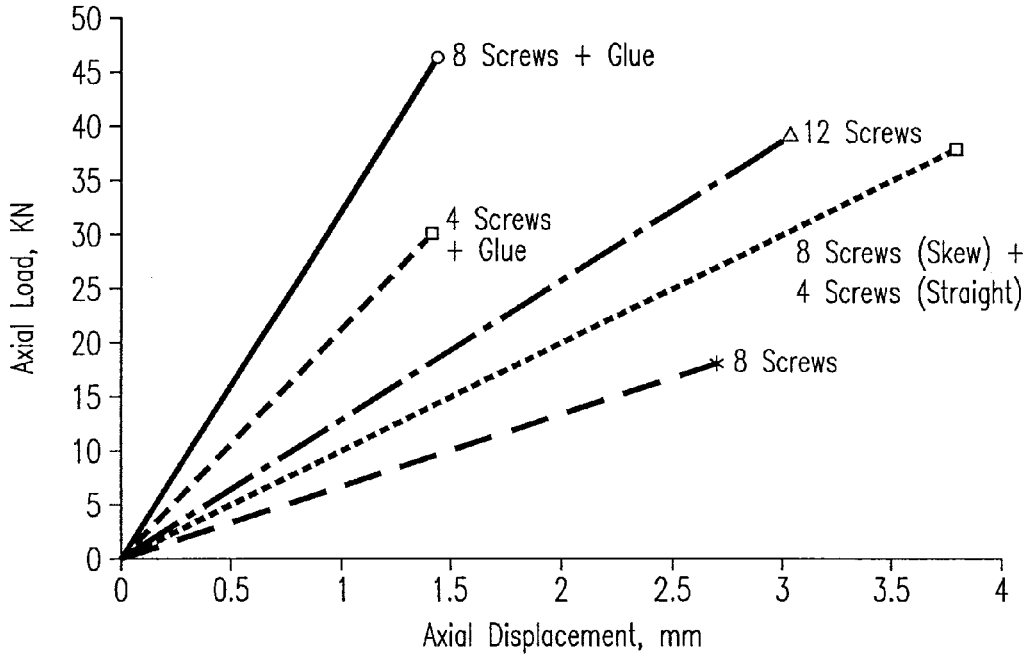
FIG. 7 is a graph showing the results of axial loading tests of cores with core adapters according to this disclosure installed in various ways.
FIG. 8 is a table summarizing the results of the tests shown in FIG. 7 from best to worst axial loading tolerance.

Tests were conducted to determine the optimum or at least the preferred method and configuration for mounting or fixing core adapters in the ends of cores according to the embodiments described above. In the test, core adapters were installed in the ends of corresponding cores in a variety of ways, including with 8 screws and glue as described above and shown in FIG. 6, as well as with 4 screws and glue, 12 screws and no glue, 8 screws skewed plus 4 screws installed radially or straight with no glue, and 8 screws and no glue. Progressively increasing axial loads were then applied to each of the test samples and the resulting axial displacement of the core adapters was measured as a function of axial load. FIG. 7 illustrates in graphical form the results of the test, and FIG. 8 illustrates the results in table form. As can be seen, the optimum configuration as determined by the least axial displacement of the adapter under load was the adapter installed with 8 screws and glue as described above. Measured axial displacement for this configuration was only 1.44 mm at 46.5 kilonewtons (kN) axial load. The worst performing configuration was 8 screws and no glue, which resulted in an axial displacement of 2.7 mm at a mere 18.2 kN axial load. Other configurations fell between these two extremes in various degrees as illustrated in FIGS. 7 and 8. The illustrated test data demonstrates that the optimum or at least the preferred method of installing core adapters using screws and adhesive in the ends of cores in terms of axial displacement performance is the installation technique detailed above using adhesive and 8 screws installed radially through the core wall and into the core adapter.

Figure 9:
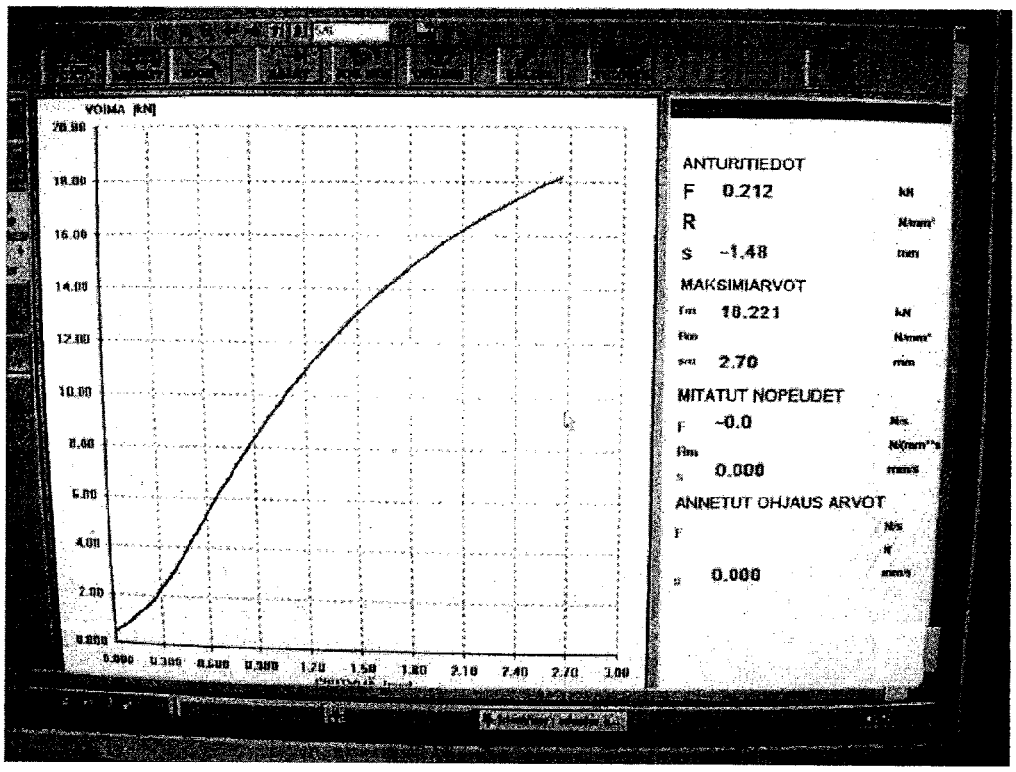
FIG. 9 is a screen view taken during an axial loading test of one configuration of core with installed adapter showing actual axial loading test results.

FIG. 9 shows the computer screen of the testing equipment during a test of axial displacement as a function of axial load for the eight screws with no glue (the worst performing) configuration. As can be seen, the curve resulting from the test is not exactly straight as shown in FIG. 7, but shows some slight roll off at the upper axial load limits of the test. In any event, it can be seen from FIG. 9 that the configuration being tested (8 screws, no glue) resulted in a 2.7 mm displacement (X-axis) at an axial load of 18.2 kN (Y-axis) as shown in FIGS. 7 and 8.

It should be noted that while testing shows that the 8 screws and adhesive installation configuration performs best and thus is considered optimum, there may be situations where maximum axial displacement performance is not required or desired. In such cases, other configurations might well be satisfactory. Accordingly, the optimum installation configuration described herein is not and should not be construed to be a limitation of the invention, but only a preferred embodiment thereof.

The core adapter may be constructed in a variety of ways using a variety of materials. For instance, it may be made of extruded plastic, molded plastic, wood, paper, or flexible metal and it may be solid, hollow, or hollow with internal support structures such as ribs formed therein, or combinations of the above. In the preferred embodiment, however, the core adapter is fabricated of convolute parallel paperboard plies that are densely wound and glued together to form the relatively thick wall of the adapter body. The axial slit is then formed by a circular saw for example completely along the length of this wall and completely through the wall from the central bore to the outside surface of the adapter. This forms a complete discontinuity in the wall to facilitate radial expansion of the core adapter. The slit also may need to facilitate a radial contraction of the core where, for instance, the core is a bit smaller than spec or out of round. The width of the slit therefore needs to be sufficient to allow for these radial contractions. The inventors have found that a slit that is from about 0 mm to about 10 mm in width, and more preferably from about 3 mm to about 4 mm in width is sufficient in this regard. These and any other materials, combinations of materials, and structure may be selected by skilled artisans and all such combinations, materials, and structure are intended to be included in the terms "core adapter" and "body" used herein.

While a core adapter with a single slit or discontinuity represents a preferred embodiment, another embodiment might include a core adapter that has more than one slit. For example, the core adapter may have two radially opposed slits that split the adapter into two halves. In such an embodiment, the halves are inserted in facing relationship into a core and affixed in place. These and other embodiments are possible and should be considered to be encompassed by the scope of the invention of which they are examples.

In addition to inserting the core adapter of this invention in a core before winding, it also may be inserted after the core is wound with material. Further, the core adapter need not necessarily be installed at the ends of a core but may in appropriate instances be installed at positions between the ends of the core. Additionally, while the length of the core adapter in the preferred embodiment is short compared to the length of the core, this is not a limitation of the invention. It may just as well be much longer and, in fact, may have a length that corresponds to the entire length of the core if desired. Thus, the core adapter may have any length desired and appropriate to a particular application within the scope of the invention.

Screws are disclosed as fasteners in the embodiments discussed above. Other fasteners may be used, however, and should be considered equivalent to the illustrated screws. For example, the core adapter may be fastened with nails, staples, wooden plugs, plastic plugs, or any other appropriate fastener, all or any of which should be considered to be included in the word "screws." Further, in some cases, fasteners may not be needed at all. For example, when using the core adapter with a winding machine having expanding core chucks, the expansion of the chucks within the adapter alone may be sufficient to expand the core adapter against the inner wall of the core and fix it in place through frictional contact or an adhesive bond.

When fasteners are used, the number and placement of the fasteners need not be as shown in the preferred embodiments, but may be any number and placement deemed appropriate for the situation. Also, the screws or other fasteners may be attached from the inside in some cases, which may be difficult but appropriate for a particular situation. Finally, in most situations, the core adapter is intended to be permanently installed, in which case adhesive may be applied and the adapter inserted into the core and expanded against the core wall until the adhesive sets. The core adapter then becomes a permanent feature of the core.

In the preferred embodiments discussed herein, the core adapter is formed as a single unit for adapting a particular core ID to another smaller ID. As an alternative, the core adapter may be provided as a system of individual nested core adapters each or at least some of which have their own axial slit so that they can be expanded radially together. The individual core adapters may then be mixed and matched to suit a particular adaptation need involving a particular core ID and needed mounting ID.

An aspect of the core adapter disclosed herein is that it adapts and adjusts automatically to cores with IDs that are slightly larger or smaller than nominal and/or that are out-of-round, which may not be true for mechanical or pneumatic core adapters.

FIGS. 10-15 depict yet another embodiment of the core adapter of this invention, and more particularly to an alternate system and method of installing and fixing the core adapter in the ends of a core. Generally, in this embodiment, the core adapter is inserted in the end of a core, without but preferably with adhesive applied to its outer surface. The core adapter is then expanded by forcing a wedge into the slit of the core, which widens the slit and thus expands the body of the core adapter radially until its outer surface engages with and wedges against the inner surface of the core.

Figure 10:
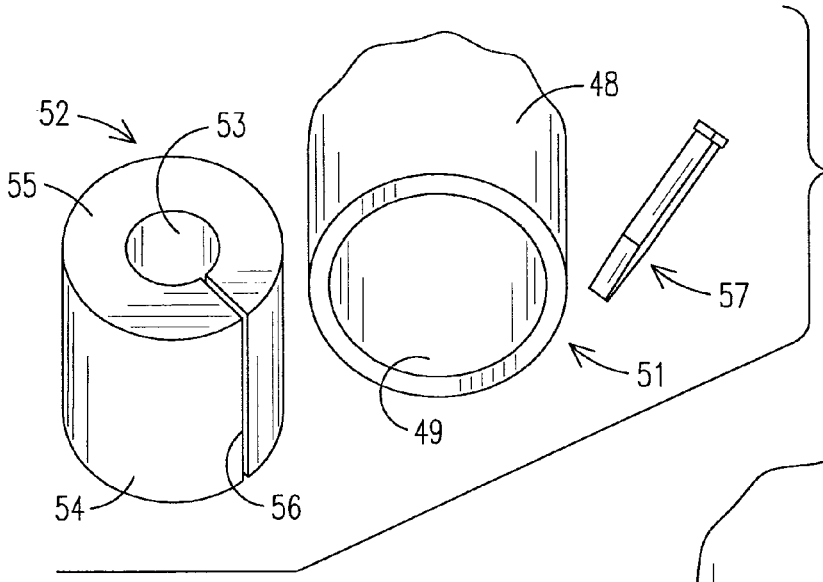
FIG. 10 is a perspective view illustrating the components of another embodiment of the core adapter according to the invention.
Figure 11:
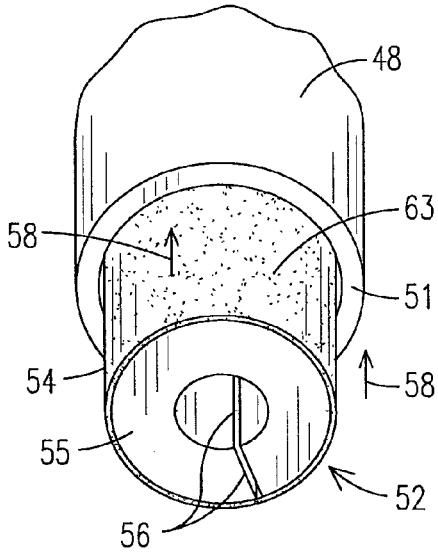
FIG. 11 is a perspective view illustrating the embodiment of FIG. 10 being slid into place within the end of a core during installation.
Figure 12:
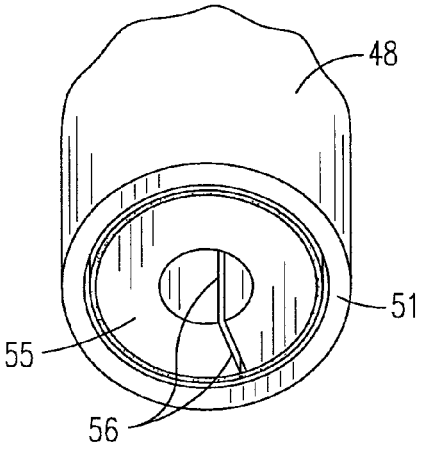
FIG. 12 is a perspective view illustrating the core adapter embodiment of FIG. 10 positioned within the end of a core.

Referring more specifically to the drawings, FIG. 10 illustrates the components of this embodiment. A paperboard core 48 has an inner surface 49 and an end 51. A core adapter 52 has a body defining a wall, a central bore 53, an outer surface 54, an end 55, and a complete discontinuity in the form of a slit 56 in the wall of the core adapter. A wedge 57, only one embodiment of which is shown in FIG. 10, is provided for expanding the core adapter as described below. FIG. 11 illustrates an initial step in the method of this embodiment. Adhesive 63 preferably is applied to the outer surface 54 of the core adapter (or the inner surface of the core or both). The core adapter, which has an OD slightly less than the ID of the core, is then slid into an end of the core as illustrated by arrows 58. The slight gap between the outer surface of the core adapter and the inner surface of the core helps ensure that the adhesive is not completely scraped off as the core adapter slides into the core. FIG. 12 illustrates the core adapter fully inserted into an end of a core with its end 55 substantially flush with the end 51 of the core. The end of the core adapter also may be recessed inside the end of the core in some applications or proud of the end of the core, both of which are included in the scope of the present invention.

Figure 13:
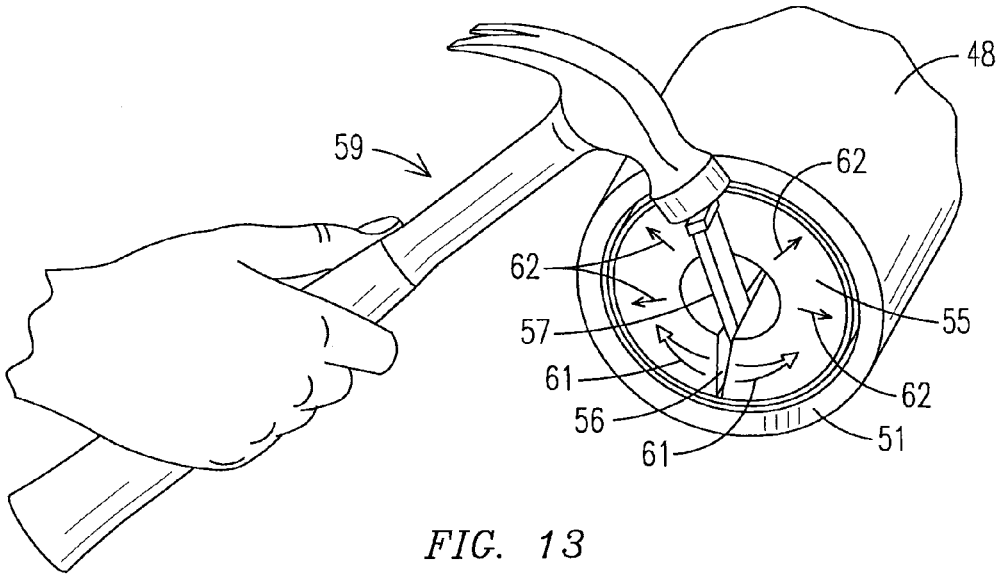
FIG. 13 is a perspective view illustrating spreading of the adapter within the end of a core with a wedge driven into the slit of the adapter.

FIG. 13 illustrates one embodiment of the method of expanding the core adapter within the end of the core. In this embodiment, a wedge in the form of a chisel-like tool is inserted at an angle into the central bore of the core adapter and positioned at the end portion of the slit 56. The chisel, which has a progressively widening body, can then be driven into the slit 56 using a hammer 59 or other appropriate tool. The progressing end of the chisel into the slit causes the slit to begin to spread out or widen as indicated by arrows 61. This, in turn, causes the entire core adapter to expand radially as indicated by arrows 62 until the outer surface of the core adapter wedges tightly against the inner surface of the core. The chisel can be left in place until the adhesive sets to bond the adapter to the core, whereupon the chisel can be removed if desired. As described above, the core adapter is configured and sized so that its central bore is correctly sized and centered with respect to the core when the core adapter is expanded within the core.

Figure 14A:
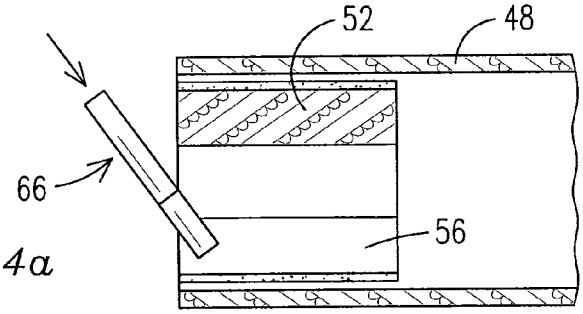
FIGS. 14*a*-14*f* illustrate various techniques of expanding a core adapter within a core using wedges and expandable tools.
Figure 14B:
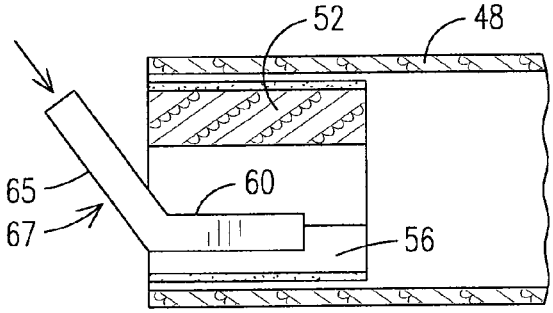

FIGS. 14*a*-14*d* illustrate a variety of embodiments of tools in the form of wedges and methods of driving them into the slit of the core adapter to widen the slit and expand the adapter radially. FIG. 14*a* illustrates the technique describe above with respect to FIG. 13. The chisel-like wedge 66 is driven into the slit from the end of the core adapter to expand the slit and the core adapter as described. FIG. 14*b* illustrates another embodiment of a tool in the form of a wedge 67 having a first relative long leg 60 and a second relatively shorter leg 65. The first leg has a blade-shaped cross section with its narrow end at the bottom. In this embodiment, the first leg of the wedge is inserted into the core adapter with its narrower bottom edge aligned with the slit 56 and the first leg 60 of the wedge is driven into the slit with a hammer or like tool applied to the end of the second leg 65, as illustrated by the arrow in FIG. 14*b*. This progressively drives the first leg 60 into the slit widening the slit and thus expanding the core adapter radially within the end of a core. This embodiment has the advantage of spreading the slit along more of its length.

Figure 14C:
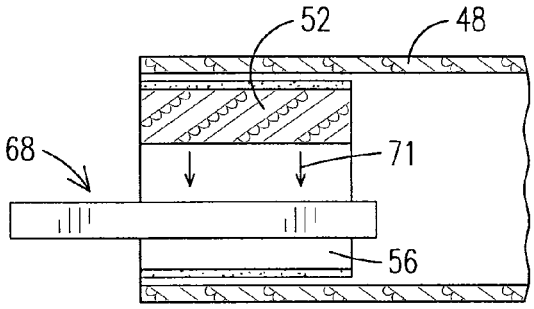

FIG. 14*c* illustrates another embodiment of a tool in the form of a wedge and method of expanding the core adapter within the core. In this embodiment, the wedge 68 is elongated and generally blade-shaped and has a bottom edge that is relatively narrow or sharpened relative to the top edge of the wedge. The wedge of this embodiment preferably extends the entire length of the slit 56 and is inserted onto the end of the core adapter with the narrow or sharpened edge aligned with the slit. A pneumatic, hydraulic, or mechanical tool is then inserted into the central bore of the core adapter and activated to drive the wedge 68 into the slit 56 as indicated by arrows 71. This forces the slit to spread apart along its entire length so that the core adapter expands radially and uniformly along its length against the inner surface of the core. Expansion of the core adapter along its entire length is an advantage over the wedge embodiments described above, which can result in more expansion at one end of the adapter than at the other. The wedge of this embodiment can be left in place or removed after setting of the adhesive to fix the core adapter in place. If left in place, the wedge preferably is made of a relatively inexpensive material such as plastic or wood.

Figure 14D:
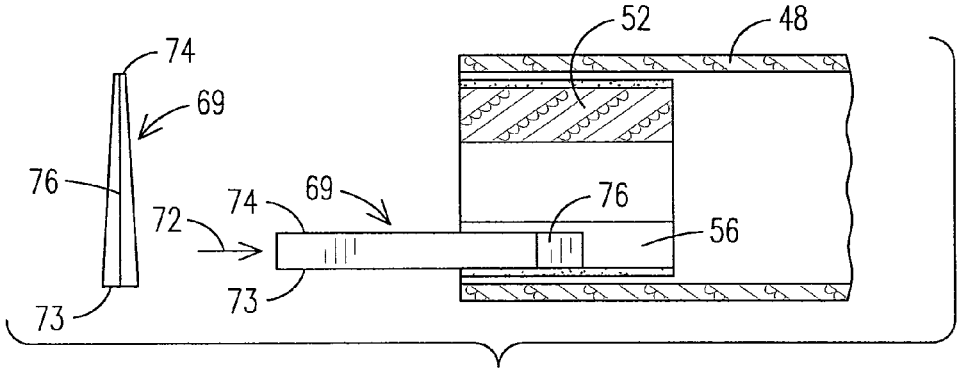

FIG. 14*d* represents another possible embodiment of a tool in the form of a wedge and a method of expanding the core adapter. This embodiment takes advantage of the fact that when the slit widens, its outer edge expands slightly more than its inner edge due to the different radii at these locations. Here, a wedge 69 has an outer edge 73, an inner edge 74, and a sharpened or chisel-shaped end 76. As illustrated on the left in FIG. 14*d*, which is an end view of the wedge from its chisel-shaped end, the outer edge 73 of the wedge is slightly wider than the inner edge 74. The difference in width between the two edges is selected to correspond to the difference in width of the slit at its outer and inner edges when the core adapter is fully expanded within the end of a core. In this embodiment, the wedge is driven into the slit axially from its end as illustrated by arrow 72 in FIG. 14*d*, with the chisel-shaped end 76 of the wedge entering the slit first.

As the wedge progressively moves along the length of the slit, the slit is progressively spread apart and widened from one end to the other. This, in turn, progressively expands the core adapter radially, again from one end to the other, against the inner surface of the core. This may have the advantage of spreading the adhesive more evenly. Further, due to the slightly tapered shape of the wedge, which corresponds to the naturally tapered shape of the slit when widened, the wedge is urged toward the inner wall of the core as it progresses through the slit. As a result, the wedge remains in the proper position within the slit during insertion. In addition, widening the slit more at its outer extent than its inner extent as it naturally wants to widen may provide more uniform pressure between the core adapter and the inner surface of the core, particularly where the slit meets the inner wall of the core, which has been found to be an issue with other wedge configurations. In this embodiment, the wedge preferably is left in place after setting of the adhesive. Further, it cannot become dislodged and move into the central bore of the core adapter due to its wider outer edge and narrower inner edge. Finally, a wedge insertion tool that imparts vibrations to the wedge during insertion may ease the movement of the wedge through the slit and insure a more uniform radial expansion of the adapter body within the core. The vibrations can be between about 60 Hz and about 500 Hz.

Figure 14E:
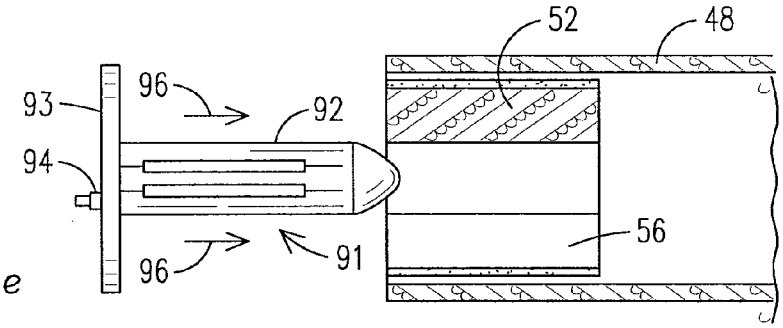
Figure 14F:
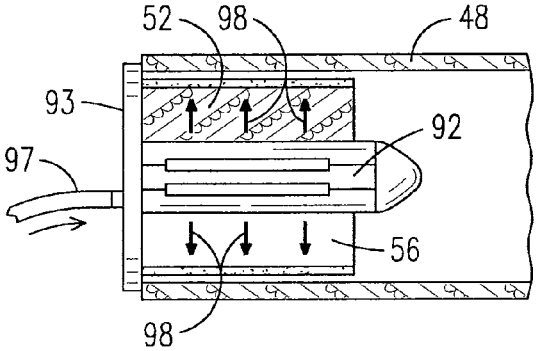

FIGS. 14*e* and 14*f* illustrate yet another technique for expanding the core adapter against the inner surface of a core until an adhesive between the two sets. The inventors have discovered that this technique is particularly successful in insuring a good bond between a core adapter and its core and good alignment of the central bore of the adapter with the axis of the core. In FIGS. 14*e* and 14*f*, a core adapter 52 having an axially extending slit 56 is disposed within the end of a core 48 with adhesive having been applied between the two. The unexpanded core adapter fits sufficiently loosely within the core to accommodate the adhesive. Before the adhesive sets, an expandable tool 91 having, in this case, a shaft 92 and a flange 93, is inserted into the internal bore of the core adapter as indicated by arrows 96. In the illustration, the expandable tool is shown generically as a pneumatically expandable core chuck having a generic pneumatic coupler 94 for receiving pressurized air. Of course, expandable core chucks of various configurations and expansion mechanisms exist as well as core chucks that are expandable hydraulically and mechanically. Thus, any appropriate expandable tool is included within the scope of the invention. The simplified generic core chuck of the figures is illustrated merely for clarity.

In FIG. 14*f*, the shaft of the core chuck has been completely inserted through the central bore of the core adapter and preferably spans the length of the adapter. A source of pressurized air 97 is coupled to the core chuck's pneumatic coupler to expand the shaft of the core chuck within the core adapter. The expanding shaft of the core chuck, in turn, imparts radially oriented pressure to the walls of the central bore of the core adapter. This, in turn, expands the core chuck outwardly against the inner wall of the core as indicated by arrows 98. The expansion is facilitated by a widening of the slit 56 of the core adapter. When fully expanded against the wall of the core, the central bore of the core adapter is precisely aligned axially with the axis of the core. Adhesive may be applied along the widened slit where it meets the inner wall of the core if desired to stabilize the core adapter at this location.

The expandable tool, a core chuck in the illustration, is left in place until the adhesive sets and bonds the core adapter to the inner wall of the core. It has been found that the use of such an expandable tool results in consistent contact between the core adapter and the inner wall of the core, which insures a consistent and complete adhesive bond. The core chuck can then be deflated and contracted so that it can be removed from the central bore of the core adapter. The adapter is then securely and permanently secured within the end of its core providing a precisely centered central opening for mounting the core onto a smaller spindle.

Figure 15:
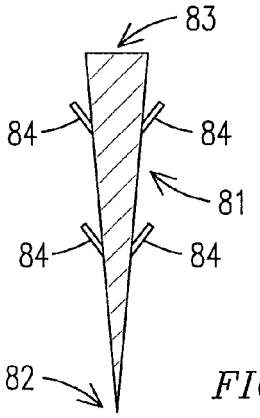
FIG. 15 is an end view of a wedge having barbs for holding the wedge within the slit of the core adapter once installed.

FIG. 15 is a cross sectional view of the blade of a wedge of the types shown in FIGS. 14*a*-14*c* in one embodiment thereof. Here, the blade 83 has a tapered body 81 that terminates in an edge 82 and is formed with angled barbs 84 intermittently or continuously extending along its outer surfaces. When the blade is driven into the slit of a core adapter, the barbs embed themselves in the walls of the slit to prevent the blade of the wedge from slipping out into the central bore of the core adapter where it could interfere with the mounting of the core onto a winding or other machine.

Another option for holding the core adapter in place involves the use of an annular metal plate at the end of a core that covers most of a core adapter inserted therein and most of or the entire wall of the core. The metal plate may have screw holes that align both with the core and the core adapter so that the plate can be secured to the core and the adapter with screws. The annular metal plate may be inset or "machined" into the core wall if desired so that it does not protrude from the end of the core. In such an embodiment, no adhesive or screws are required to fix the core adapter directly to the core. Instead, the metal plate holds the two together and the core adapter can be removed from the core easily for re-use.

The invention has been described herein and illustrated in the drawings in terms of preferred embodiments and methodologies considered by the inventors to represent the best modes of carrying out the invention. As discussed, many modifications may be made to these example embodiments and the result will still incorporate the invention. It will thus be understood that a wide variety of additions, deletions, and modifications both subtle and gross, including those above and others, might be made to the illustrated embodiments without departing from the spirit and scope of the invention as set forth in the claims.

What is claimed is:

1. A core adapter insertable in an end of a core configured to support a product wound thereon, the core adapter comprising a generally cylindrical elongated body having a substantially constant outer diameter throughout its length, a wall, an outer surface, a central bore, and at least one discontinuity formed in the wall and extending along the length of the body, a first outer diameter of the body, in a non-flexed state, being less than an inner diameter of the core into which the core adapter is to be inserted, the discontinuity being configured to permit the body to be expanded within the core from the first outer diameter to a second outer diameter that is substantially the same as the inner diameter of the core facilitated by an increase in the width of the discontinuity, wherein the core adapter is securable within the end of the core prior to winding the product thereon.

2. The core adapter of claim 1 further comprising attachment locations on the body or the core for receiving screws to secure the core adapter to the core in which it is inserted.

3. A method of installing a core adapter in a tubular core having an internal surface, an external surface configured to support a product wound thereon, and a longitudinal centerline axis, the core adapter having a generally cylindrical body with a first outer diameter, in a non-flexed state, that is smaller than an internal diameter of the core, the body being radially expandable, a central bore extending axially through the body, and an axial discontinuity extending along the length of the cylindrical body, the method comprising the steps of:

(a) placing the core adapter, in the non-flexed state, through an end of the core to a selected position; and (b) progressively expanding the body from the first outer diameter toward a second outer diameter that is greater than the first outer diameter while simultaneously widening the axial discontinuity until the body expands into engagement with the internal surface of the core to secure the core adapter in the core and align the central bore of the adapter with the axis of the core.

4. The method of claim 3 wherein step (b) comprises progressively attaching the core adapter to the core with screws.

5. The method of claim 4 wherein the step of progressively attaching comprises tightening the screws in a predetermined sequence such that the core adapter is urged uniformly and firmly against the core as the core adapter expands.

6. The method of claim 5 wherein the predetermined sequence includes from one side of the discontinuity of the core adapter progressively around the core adapter to the other side of the discontinuity.

7. The method of claim 4 wherein the screws are extended through the core adapter and are threaded into the core.

8. The method of claim 4 wherein the screws are extended through the core and threaded into the core adapter prior to winding the product on the external surface of the core.

9. The method of claim 3 further comprising applying adhesive to the core or to the core adapter or to both the core and the core adapter prior to step (a).

10. The method of claim 9 wherein step (b) comprises attaching the core adapter to the core with screws.

11. The method of claim 9 wherein step (b) comprises spreading apart the discontinuity.

12. The method of claim 11 wherein the step of spreading apart the discontinuity comprises urging a wedge into the discontinuity.

13. The method of claim 9 wherein step (b) comprises applying outwardly directed pressure to an inner surface of the central bore.

14. The method of claim 13 wherein applying outwardly directed pressure to the inner surface of the central bore comprises inserting an expandable tool into the central bore and expanding the tool.

15. The method of claim 14 wherein the step of expanding the tool comprises expanding the tool using pneumatic, hydraulic, or mechanical means.

16. The method of claim 9 wherein step (b) comprises expanding the body with an applied force until the adhesive sets and then removing the applied force.

17. The method of claim 16 wherein the applied force is applied from within the central bore of the core adapter.

18. The method of claim 17 wherein the applied force is applied with an expandable tool removably inserted through the central bore.

19. The method of claim 3 wherein step (b) comprises urging the discontinuity apart to widen the discontinuity and cause the body to expand from the first outer diameter toward the second outer diameter.

20. The method of claim 19 wherein urging the discontinuity apart comprises inserting a wedge into the discontinuity.

21. The method of claim 20 wherein inserting the wedge comprises urging the wedge substantially radially relative to the core adapter into the discontinuity.

22. A core adapter system for supporting a core having an internal surface, an external surface configured to support a product wound thereon, and a longitudinal centerline axis, the core adapter system comprising:

a generally cylindrical core adapter securable within the end of the core prior to winding the product thereon and having a radially expandable body defining a wall, an outer surface, a central bore, at least one slit formed through the wall of the body, with a first outer diameter of the body in a non-flexed state being less than an inner diameter of the core into which the core adapter is to be inserted;

a tool urging the body of the core adapter to expand radially from the first outer diameter toward a second outer diameter greater than the first outer diameter facilitated by a widening of the slit.

23. The core adapter system of claim 22 wherein the tool comprises a shaft sized to be inserted through the central bore and a mechanism for expanding the shaft against the wall of the central bore to impart outwardly directed pressure thereto.

24. The core adapter system of claim 23 wherein the mechanism for expanding the shaft comprises pneumatic, hydraulic, or mechanical means.

25. The core adapter system of claim 22 wherein the system further comprises adhesive selected to be applied to an interface between the core adapter and a core and to bond the two together upon setting.

* * * * *